US010184267B2

(12) United States Patent
Kuo et al.

(10) Patent No.: US 10,184,267 B2
(45) Date of Patent: Jan. 22, 2019

(54) SUPPORTING MECHANISM FOR GLASS FENCE

(71) Applicants: Chingyao Kuo, Luzhou (TW); Norman William Liefke, Surrey (CA)

(72) Inventors: Chingyao Kuo, Luzhou (TW); Norman William Liefke, Surrey (CA)

( * ) Notice: Subject to any disclaimer, the term of this patent is extended or adjusted under 35 U.S.C. 154(b) by 276 days.

(21) Appl. No.: 15/200,114

(22) Filed: Jul. 1, 2016

(65) Prior Publication Data

US 2018/0002949 A1 Jan. 4, 2018

(51) Int. Cl.

| | |
|---|---|
| ***E04F 11/18*** | (2006.01) |
| ***E04H 17/16*** | (2006.01) |
| ***E04H 17/22*** | (2006.01) |
| ***F21V 33/00*** | (2006.01) |
| *F21Y 115/10* | (2016.01) |

(52) U.S. Cl.

CPC ..... *E04H 17/168* (2013.01); *E04F 11/1812* (2013.01); *E04F 11/1853* (2013.01); *E04H 17/22* (2013.01); *F21V 33/006* (2013.01); *F21Y 2115/10* (2016.08)

(58) Field of Classification Search

CPC .... F21V 33/006; E04H 17/16; E04F 11/1851; E04F 11/1853; E04F 11/1812

See application file for complete search history.

(56) References Cited

U.S. PATENT DOCUMENTS

| | | | | |
|---|---|---|---|---|
| 4,870,793 | A * | 10/1989 | Tomlinson | E04B 2/7405 52/241 |
| 2010/0225040 | A1* | 9/2010 | Allen | E04F 11/1851 269/297 |
| 2015/0240517 | A1* | 8/2015 | Lopez | E04F 11/1812 256/24 |
| 2017/0037653 | A1* | 2/2017 | Schopf | E04H 17/22 |
| 2018/0135669 | A1* | 5/2018 | Dagand | F16B 2/14 |

* cited by examiner

*Primary Examiner* — Andrew Coughlin
(74) *Attorney, Agent, or Firm* — Bacon & Thomas, PLLC

(57) ABSTRACT

A supporting mechanism for a glass fence is provided. The supporting mechanism has a base, a main body, two sets of anti-collision rubber for contacting with the glass fence, an height-adjustment block, an adjustment slider, and an installation slot for insertion of the glass fence in vertical direction. The installation slot is provided on the main body along a vertical direction of the main body, the installation slot divides the main body into two sub-bodies, each sub-body has an inner wall facing the installation slot. The height-adjustment block is provided at a lower end position of the installation slot, an inner space is provided within the height-adjustment block for receiving an LED device generating light. The adjustment slider selectively moves by an adjustment screw such that height of the height-adjustment block is adjustable. As the glass fence is installed within the installation slot and on the height-adjustment block, installation height of the glass fence is adjustable by the adjustment screw.

8 Claims, 7 Drawing Sheets

SUPPORTING MECHANISM FOR GLASS FENCE

BACKGROUND OF THE INVENTION

1. Field of the Invention

The present invention relates to a supporting mechanism, capable of generating LED light, allowing insertion of a glass fence which is height adjustable.

2. Description of Related Art

Typically, a fence is usually provided for guiding the advancing direction of pedestrians and for the security of pedestrians along the walkway in some environments. In typical designs of fence system, multiple columns spaced from each other are provided. The columns are usually connected to each other by supports and then installed on the ground or the likes. Conventionally, the support is provided with two connection sides. One connection side connects with column and another one connects to the ground or the likes. However, the columns and supports are both stiffness members. After the fixation of both members, gap inevitably exists between them possibly making the fence to loosen easily. Furthermore, the conventional approach does not allow height adjustment of the fences.

SUMMARY OF THE INVENTION

In view of the foregoing disadvantages in the arts, it is a main objective of the present invention to provide a supporting mechanism for a glass fence which can be installed easily on areas of balcony, stairways inside or outside the building, or outdoor swimming pool . . . etc.

Yet another objective of the invention is to provide a supporting mechanism which allows the height adjustment of the glass fence before being finally installed and provides LED light for aesthetic or safety reasons.

Yet another objective of the invention is to provide a supporting mechanism which is casted by aluminum alloy and is simple in structure and easy to install.

Yet another objective of the invention is to provide a supporting mechanism having anti-collision rubbers. The anti-collision rubbers are used to buffer the impact might be unexpectedly applied to the glass fence.

Yet another objective of the invention is to provide a supporting mechanism having a height-adjustment block on which the glass fence sits. The height-adjustment block is driven to adjust the height of the glass fence.

Yet another objective of the invention is to provide a supporting mechanism having a lateral-frame. The lateral-frame is used to install the supporting mechanism on the sidewall of stairway or the likes.

Yet another objective of the invention is to provide a supporting mechanism having translucent mask which is made of glass or PC. The LED light passes through the translucent mask and is visible to people nearby.

Yet another objective of the invention is to provide a supporting mechanism in form of bullet-shape (semi-olive shape) which is simple in structure, easy to make and to install.

The objective, shape, structure, characteristics, and efficacy of the present invention will become more apparent by describing in detail the embodiments thereof with reference to the attached drawings of which:

DETAILED DESCRIPTION OF THE PREFERRED EMBODIMENT

The present invention is directed to a supporting mechanism for support of a glass fence on a surface.

Figure 1:
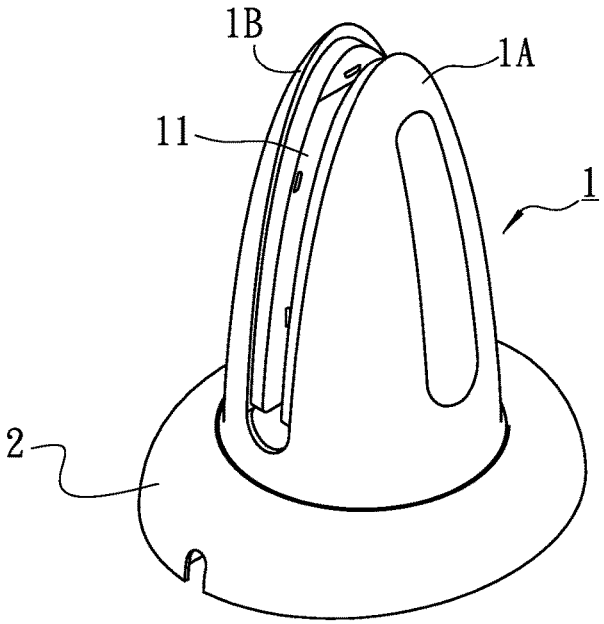
FIG. 1 shows an assembly form of the present invention in a perspective view.
Figure 2:
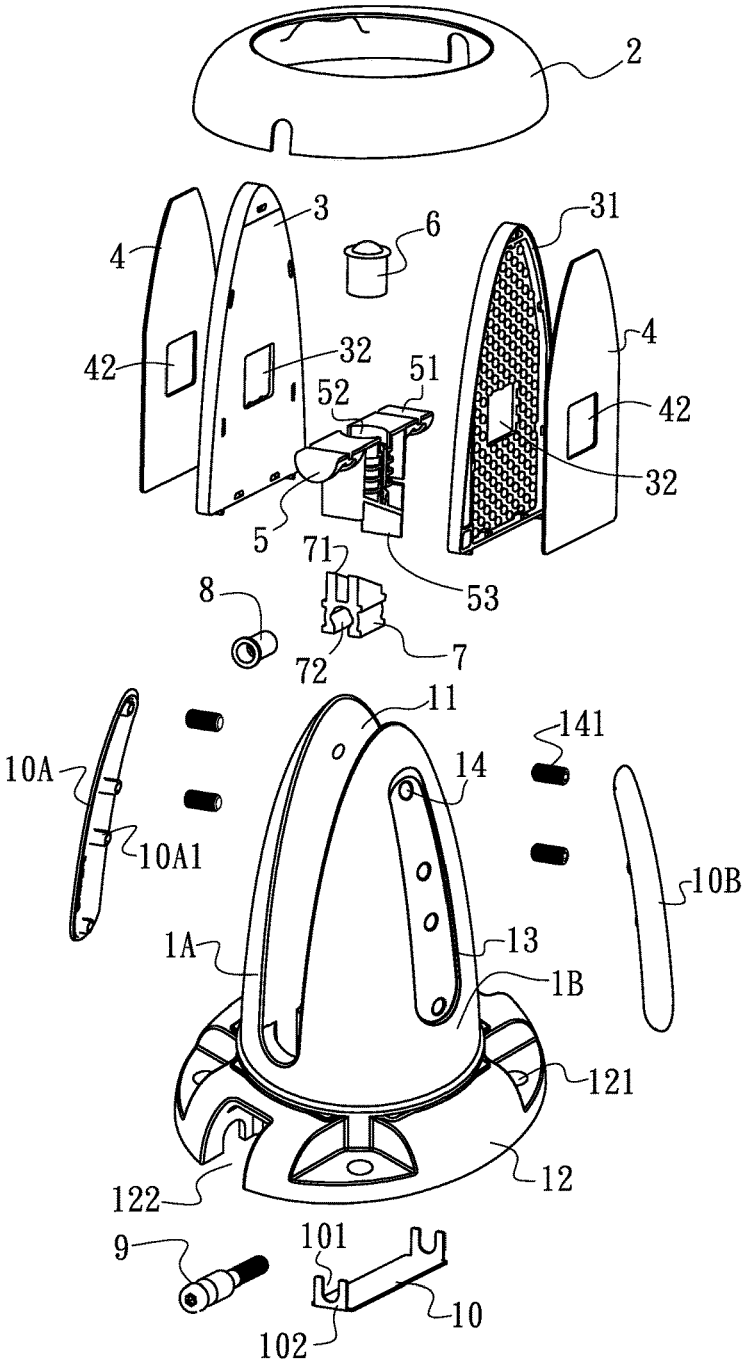
FIG. 2 shows an explosive diagram of the present invention in a perspective view.
Figure 6:
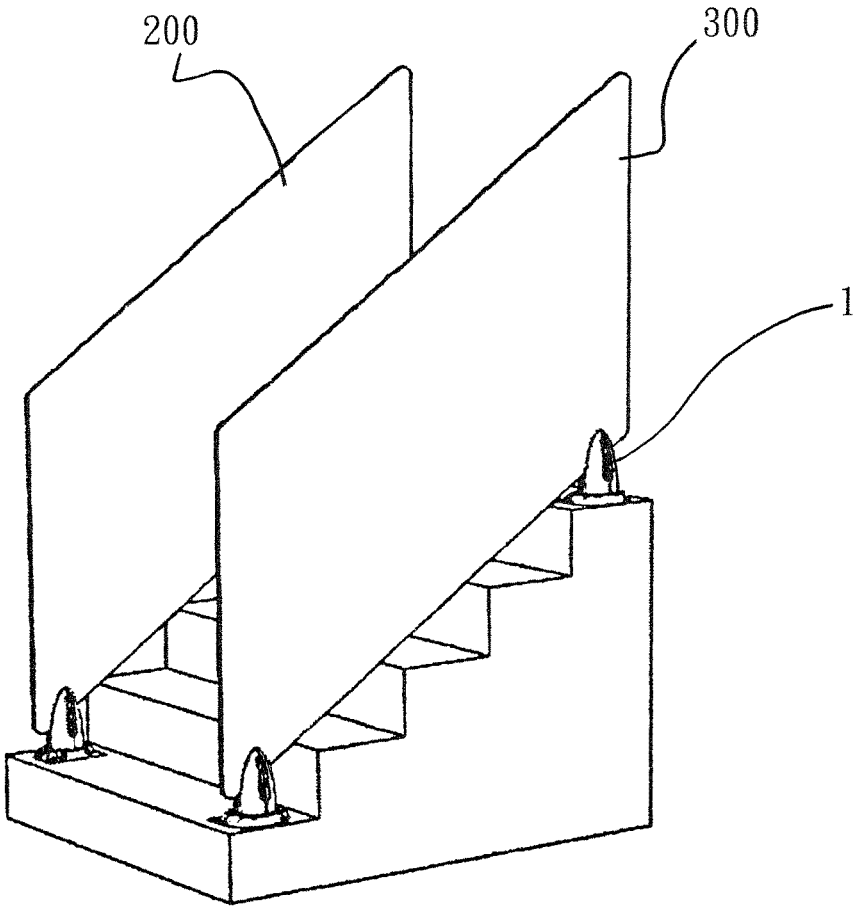
FIG. 6 shows the implementation of the present invention on step surface of a stairway.
Figure 7:
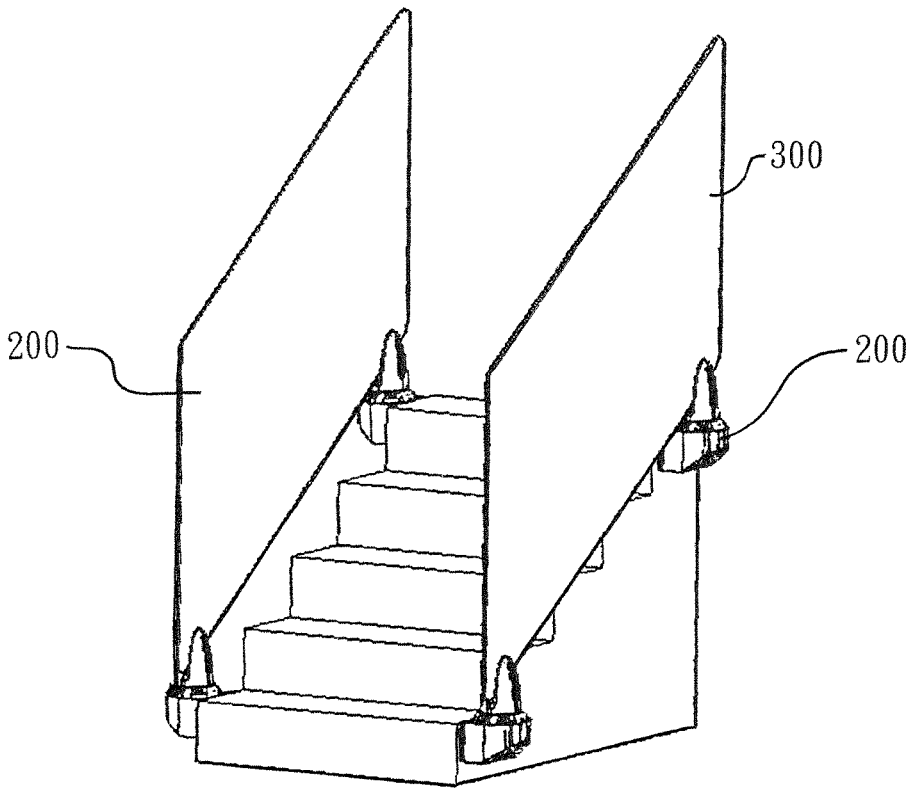
FIG. 7 shows the implementation of the present invention on sidewall of a stairway.

The supporting mechanism of the present invention, as shown in FIGS. 1 and 2, includes a main body 1, two sets of anti-collision rubber 3 for contacting with the glass fence 200 or 300 (please refer to FIG. 6 & FIG. 7), a height-adjustment block 5, and an adjustment slider 7. The main body 1 has a base 12 and an installation slot 11, and a base cover 2 for covering the base 12. Running along a vertical direction and about the central portion of the main body 1, the installation slot 11 allows insertion of a glass fence 200 or 300 as shown in FIG. 6 or 7. The installation slot 11 divides the main body 1 into two equally sub-bodies 1A and 1B, and each sub-body has an inner wall facing the installation slot 11 as shown in FIG. 3.

As shown in FIG. 2, multiple holes 121 equally spaced from each other along circumferential direction of the base 12, allowing passage of screw (not shown) to be provided on the base 12. The screws, passing through the holes 121, are utilized to connect the base 12 to ground floor or step surface of stairway as shown in FIG. 6. A passage 122 is provided in the base 12, along radial direction of base 12 and located corresponding to the installation slot 11, to vertically communicate with the installation slot 11. After the base 12 is affixed to step surface of stairway, the base cover 2 is then covered onto the base 12 as shown in FIG. 3.

Figure 3:
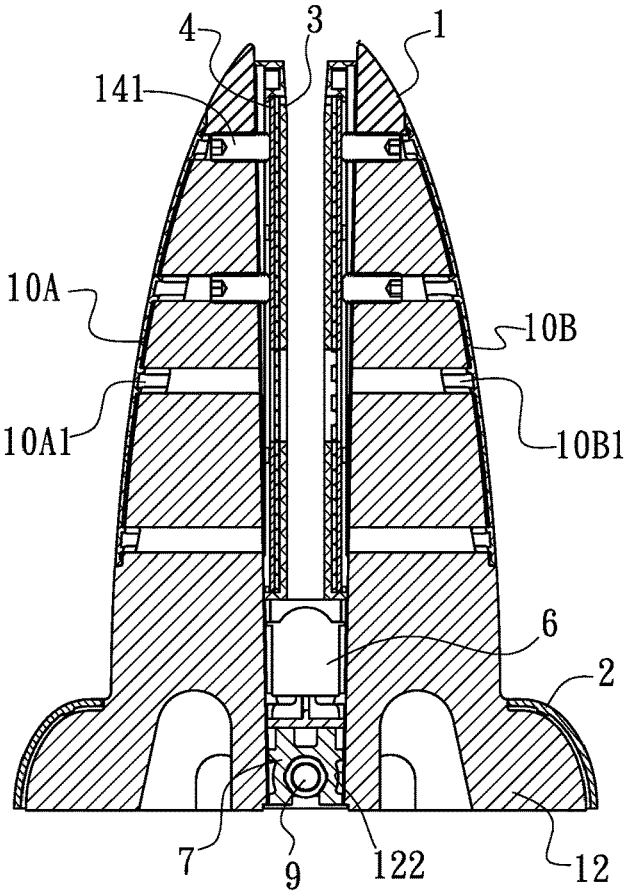
FIG. 3 shows a sectional view of the present invention.

As shown in FIGS. 2 and 3, two set of anti-collision rubber 3 and backing plate 4 are provided and are installed within the installation slot 11 and onto the inner walls of sub-body 1A and 1B respectively. Each set of anti-collision rubber 3 and backing plate 4 is spaced from another set of anti-collision rubber 3 and backing plate 4, and together define a space allowing insertion of the glass fence 300 therein as shown in FIG. 3. An area of cavity 31 is provided on the backside of anti-collision rubber 3 allowing engagement and connection of the backing plate 4 thereto. On the anti-collision rubber 3 and backing plate 4, windows 32-42 are provided to let the light (generated from lighting devices) pass through.

Figure 4:
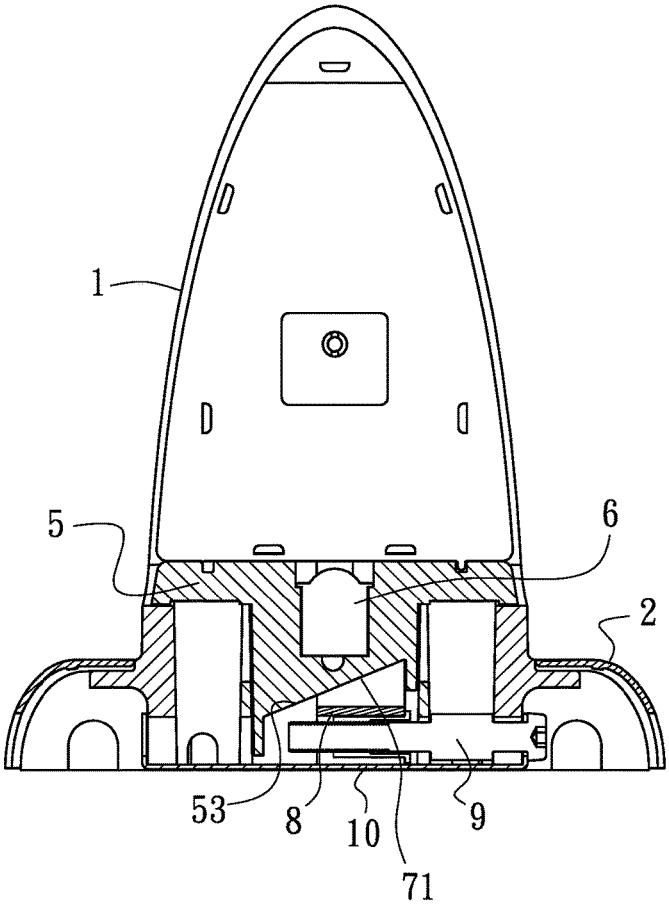
FIG. 4 shows another sectional view of the present invention.
Figure 5:
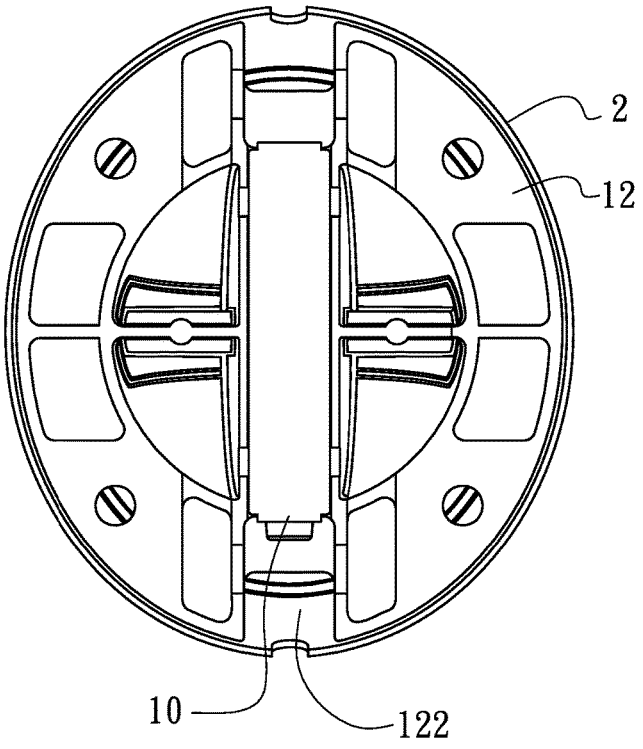
FIG. 5 shows bottom view of the present invention.

As shown in FIGS. 2 and 4, the height-adjustment block 5 has a rectangular surface 51 for disposition of a glass fence 200 or 300 thereon. Within the height-adjustment block 5, a receiving space 52 is provided for accommodation of an LED device 6 for generating light. The lower end of the height-adjustment block 5 has an inclined surface 53, which relatively movably touches against an inclined surface 71 of the adjustment slider 7 which is located below the height-adjustment block 5. As will be clear in the followings, as the adjustment slider 7 is driven along its moving direction, the adjustment block 5 is moved upwardly or downwardly accordingly. The movement of the adjustment block 5 then lift or drop the height of glass fence siting on the rectangular surface 51.

As shown in FIGS. 2 and 3, the inclined surface 71 is provided on the upper end of the adjustment slider 7. The inclined surface 71 is allowed to move relative to the inclined surface 53. The bottom of the adjustment slider 7 is provided with an axial tunnel 72 which engages with a sleeve 8. The inner channel of sleeve 8 has female-screw driven by an adjustment screw 9 whose neck part sits and rotate on an edge defined by recess 101. By rotating the adjustment screw 9, the adjustment slider 7 moves forward or backward through the sleeve 8 and assistance of pad 10. That is, a pad 10 is provided at a bottom end of the passage 122 of the main body 1 for inhibiting the axial movement of the adjustment screw 9. In other words, the adjustment screw 9 can be rotated only and cannot move axially. On the pad 10, a recess 101 on each of two side plates 102 is provided. One recess 101 accommodates a neck part of the adjustment screw 9, and the neck part sits on and rotates on peripheral edge defined by the recess 101 as the adjustment screw 9 is rotated. Due to this arrangement, the adjustment screw 9 can only rotate and cannot move in axial direction. On the other hand, the driven sleeve 8 and therefore the adjustment slider 7 can move forward or backward when the adjustment screw 9 rotates. Two sides of the adjustment slider 7 and height-adjustment block 5 are respectively restricted by the length of passage 122 of base 12. As the adjustment slider 7 moves, through the inclined surface 71, the height-adjustment block 5 moves upward or downward. As such, the installation height of the glass fence 300 installed within and rests on the rectangular surface 51 can then be adjusted according to the needs.

Referring to FIGS. 2, 3, 4, 5, due to the installation slot 11, the main body 1 is divided into two equally sub-bodies. Each surface of two sub-bodies is formed with an area of cavity 13 of a general strip-shape. Within the area of cavity 13, multiple female-screws 14 are provided allowing connection of screws 141 or protrusions 10A1, 10B1. The translucent masks 10A, 10B are provided to fit into the area of cavity 13. On the inner side of the translucent masks 10A, 10B, the protrusion 10A1 or 10B1 respectively corresponds to one female-screw 14. By insertion of the protrusion 10A1, 10B1 into the corresponding female-screw 14, the translucent masks 10A-10B can be removably attached to one sub-body as shown in FIG. 3. Furthermore, the light of LED mechanism 6 within the main body 1 passes through the windows 32, 42, the female-screws 14, and the translucent masks 10A, 10B, and therefore are visible.

While being installed, the glass fence 200/300 is first inserted into the installation slot 11 and sits on the rectangular surface 51. The desired installation height then is adjusted and achieved by the operations of the adjustment slider 7 and the height-adjustment block 5 mentioned above. Afterwards, the anti-collision rubber 3 along with the backing plate 4 are installed within the installation slot 11 and face against on one side a corresponding inner wall of the sub-body, and on the other side one surface of glass fence 300 within the installation slot 11. Then, the operator may select the suitable female-screws 14 and drives the screws 141 into the selected female-screws 14. The screw 141 then drives the backing plate 4 and the anti-collision rubber 3 forward and then affix the glass fence 300 firmly. In this way, the glass fence 300 is affixed at a desired height and is cushioned by the anti-collision rubber 3. Afterwards, the translucent masks 10A, 10B are engaged with the sub-bodies respectively at the area of cavity 13 respectively. Through the translucent masks 10A, 10B allowing the pass-through of the LED light, the illumination or warning purpose to the surrounding areas is achieved.

The supporting mechanism of the invention can be installed on the upper surface of step of stairway as shown in FIG. 6. If the width of stairway is limited or for other reasons, as shown in FIG. 7, by a lateral-frame 200, the supporting mechanism can be installed on the side surface of the stairway.

Alternatively, the shape of main body 1 of the supporting mechanism is substantially in form of a bullet or semi-olive shape.

From above recitations, compared to the state-of-arts, the present invention has following advantages:

1) In addition to the capability of height adjustment of glass fence, the LED mechanism is also provided in the supporting mechanism to generate light useful for insuring safety of nearby area in the night.

2) In one preferred embodiment, the supporting mechanism may be casted using aluminum alloy. Combining the bullet-type shape of the supporting mechanism, the strength, stiffness and stability of the supporting mechanism is superior than that made of the stainless steel.

3) The supporting mechanism has simple structure and is easy to install.

What described above are for illustrating the preferred embodiments of the present invention, not for limiting the structure and features of the present invention. Any person skilled in the art shall be able to make modifications and changes to the embodiments without departing from the spirit of the present invention.

What is claimed is:

1. A supporting mechanism for a glass fence, the supporting mechanism comprising:

a main body, two sets of anti-collision rubber for contacting with the glass fence, a height-adjustment block, and an adjustment slider, the main body having a base and an installation slot, for insertion of the glass fence in a vertical direction, the installation slot being provided on the main body along a vertical direction of the main body, the installation slot dividing the main body into two sub-bodies, each sub-body having an inner wall facing the installation slot, and the height-adjustment block being provided at a lower end position of the installation slot, the adjustment slider selectively moves by an adjustment screw such that height of the height-adjustment block is adjustable, whereby, as the glass fence is installed within the installation slot and on the height-adjustment block, installation height of the glass fence is adjustable by the adjustment screw, wherein an upper end of the adjustment slider has a first inclined surface, a lower end of the height-adjustment block has a second inclined surface, the first inclined surface contacts with and moves relatively to the second inclined surface in a way such that the first inclined surface of the adjustment slider moves in a forward and backward direction in an axial direction as the adjustment screw is operated.

2. The supporting mechanism as claimed in claim 1, an outer surface of the anti-collision rubber is provided with an area of cavity for accommodating a backing plate therein for pressing against the inner wall of one sub-body, and an outer surface of each sub-body is provide with an area of cavity, multiple female-screws with open ends being provided in each sub-body along a thickness direction of the sub-body, the open end being configured and accessible within the area of cavity of each sub-body allowing screw of a male-screw into the female-screw such that the male screw provides a pressing force against the glass fence through the backing plate and the anti-collision rubber.

3. The supporting mechanism as claimed in claim 2, further comprising a translucent mask having multiple protrusions, engagement of translucent mask with the sub-body is implemented by insertion of multiple protrusions into the corresponding female-screws, and light generated by a LED device can be visible through the translucent mask.

4. The supporting mechanism as claimed in claim 3, wherein the translucent mask is made by glass or PC (Poly Carbonate).

5. The supporting mechanism as claimed in claim 1, further comprising a lateral-frame at a lower end of the base, the lateral-frame is used to attach a sidewall of a stairway.

6. The supporting mechanism as claimed in claim 1, further comprising a LED device generating light, wherein an inner space being provided within the height-adjustment block for receiving the LED device generating light.

7. The supporting mechanism as claimed in claim 1, wherein the sub-body is casted by aluminum alloy.

8. The supporting mechanism as claimed in claim 1, wherein shape of the main body is substantially in form of a bullet.

* * * * *